US006824461B1

(12) United States Patent
Dolev

(10) Patent No.: US 6,824,461 B1
(45) Date of Patent: Nov. 30, 2004

(54) HAIR DEPILATING DEVICE AND METHOD FOR IMPROVED DEPILATING COVERAGE

(76) Inventor: Moshe Dolev, 17 Bereishit St., Ramat HaSharon (IL), 47201

( * ) Notice: Subject to any disclaimer, the term of this patent is extended or adjusted under 35 U.S.C. 154(b) by 0 days.

(21) Appl. No.: 10/440,105

(22) Filed: May 19, 2003

(51) Int. Cl.[7] ..... A22B 5/08
(52) U.S. Cl. ..... 452/83; 452/71; 452/82
(58) Field of Search ..... 452/71, 82, 83, 452/84, 85; 606/131, 133

(56) References Cited

U.S. PATENT DOCUMENTS

| | | | | |
|---|---|---|---|---|
| 5,041,123 | A | 8/1991 | Oliveau et al. | |
| 5,057,115 | A | * 10/1991 | Dolev | 606/133 |
| 5,196,021 | A | * 3/1993 | Kabla | 606/133 |
| 5,281,233 | A | * 1/1994 | Dolev | 606/133 |
| 5,462,557 | A | 10/1995 | Jordan et al. | |
| 5,857,903 | A | * 1/1999 | Ramspeck et al. | 452/82 |
| 5,976,157 | A | * 11/1999 | Yiu | 606/133 |
| 6,033,416 | A | * 3/2000 | Louison et al. | 606/133 |
| 6,123,713 | A | * 9/2000 | Yiu et al. | 606/133 |
| 6,287,190 | B1 | * 9/2001 | Inoue et al. | 452/82 |
| 6,436,106 | B2 | * 8/2002 | Yiu | 606/133 |
| 6,451,028 | B1 | * 9/2002 | Sanchez-Martinez et al. | 606/133 |
| 6,585,743 | B2 | * 7/2003 | Dolev | 606/133 |
| 6,676,670 | B1 | * 1/2004 | Dolev | 606/133 |

FOREIGN PATENT DOCUMENTS

| | | |
|---|---|---|
| JP | 9-308521 | * 12/1997 |

* cited by examiner

*Primary Examiner*—Peter M. Poon
*Assistant Examiner*—David Parsley
(74) *Attorney, Agent, or Firm*—Edward Langer; Shiboleth, Yisraeli, Roberts, Zisman & Co.

(57) ABSTRACT

A hand-held, motorized depilating device, introducing a novel mechanical design to provide improved depilating coverage and hair plucking efficiency, without requiring the user to pass the device over the same given skin, area numerous times. The hair-plucking assembly is rotatable about a shaft and includes at least two disc assemblies, each comprising a pair of complimentary discs, mounted on a hub, and having radially extending arms which terminate in a flattened peripheral portion, which when pressed against a corresponding portion forms a trap for the hair. At least one of the radially extending arms is bent so that the associated hair trap lies in a different predetermined plane than the other hair-traps associated with that disc assembly. This staggered arrangement results in improved depilating coverage. In another embodiment, the hub's edge has formed thereon a pinch plate, disposed in between the complementary discs, thereby doubling the number of hair-traps, and greatly increasing depilating efficiency.

17 Claims, 11 Drawing Sheets

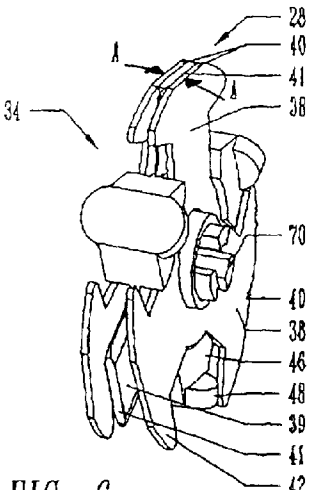
FIG. 4 (prior art)
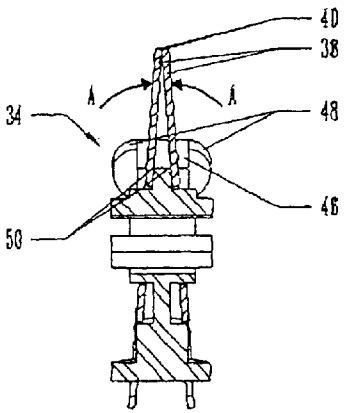
FIG. 5 (prior art)
FIG. 6 (prior art)
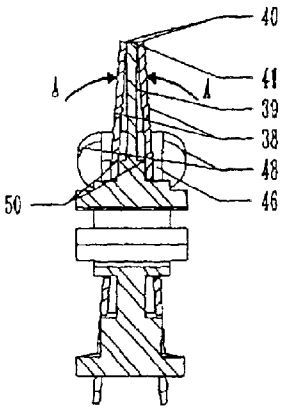
FIG. 7 (prior art)
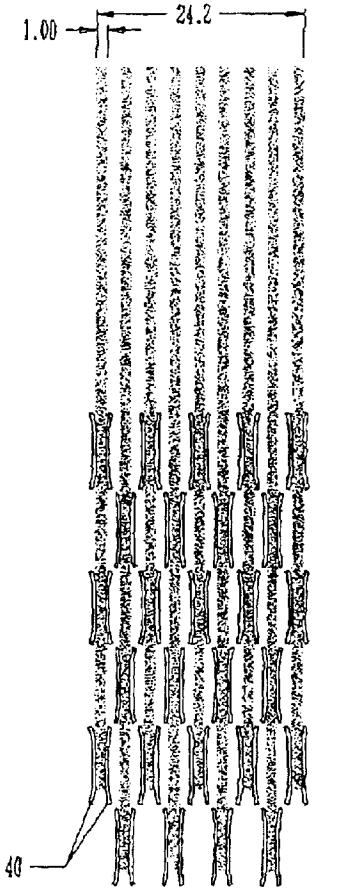
FIG. 8 (prior art)

HAIR DEPILATING DEVICE AND METHOD FOR IMPROVED DEPILATING COVERAGE

FIELD OF THE INVENTION

The present invention relates to depilating devices, and more particularly, to a hand held, motorized depilating device for removing wanted skin hair, utilizing a novel mechanical design to provide improved depilating coverage, to achieve the desired depilating effect per give: skin area without requiring the user to pass the device over it numerous times, thereby increasing the hair plucking efficiency.

BACKGROUND OF THE INVENTION

A problem shared by many of the depilating devices currently on the market is that the user must pass the device over the same given skin area numerous times in order to achieve the depilating effect desired, thus providing limited depilating coverage. This is commonly the result of how the hair-traps are aligned one with respect to the other and to the given skin area being depilated. Without optimal alignment of hair-traps in relation to coverage of skin area, hair plucking efficiency is decreased.

One approach for increasing the area effectively treated per depilating pass has been disclosed in U.S. Pat. No. 6,287,190 to Inoue. The suggested approach is to mechanically force the hair-plucking assembly to traverse the given skin area from side to side, while simultaneously rotating about a shaft. Both types of motion are powered by means of the device's motor.

This approach has two major drawbacks:

1. The necessity to add moving parts, which translates into increased production costs and energy consumption.
2. A substantial reduction in depilating efficiency as a result of diminishing the effective hair-trap opening exposed to the skin surface at any given time.

U.S. Pat. No. 5,281,233 to Dolev discloses a novel hair removal device, which includes disc assemblies, which are designed to alternately close and open a large number of relatively large hair-traps.

The Dolev patent discloses a depilating device comprising a hair-plucking assembly being rotatable about a shaft and including one or more disc assemblies. Each disc assembly comprises a pair of complementary discs, each of which has one or more radially extending arms, which terminate in a flattened peripheral portion. The disc assemblies also include a hub, which accommodates said pair of discs, one on each of its axial faces.

The hub has shoulders for engaging the arms of each of the discs so as to impart rotational motion to the discs upon the rotation of the hub. The hub also has pairs of protrusions, which extend axially beyond the plane of arms of each disc. The hub further has an edge, which is perpendicular to its axis.

In one embodiment, each of the arms of the pair of discs is pivotable about the edge so as to alternately bring two flattened peripheral portions into contact thus closing a hair-trap and then opening the trap to release the depilated hairs.

In an alternate embodiment, the edge of the hub includes a pinch plate, which projects radially outwardly from the edge. It is disposed in a plane opposite the plane of the flattened peripheral portion, so as to be flush with the flattened peripheral portion. Each arm of the pair of discs is pivotable about the edge so as to alternately bring two flattened peripheral portion and the pinch plate into contact thus closing two hair-traps simultaneously and then opening the traps to release the depilated hairs.

In both embodiments, however, the hair-traps are lined up one after the other, i.e. in a tandem arrangement. In a single depilating pass over a given skin area, a narrow band of skin area is treated by this tandem arrangement of hair-traps. Strips of skin, between these bands, are not treated. As a result, the device's efficiency is reduced and consequently, the user must pass the device over the same given skin area several times in order to achieve the depilating effect desired.

Therefore, it would be desirable to provide a depilating device that enables improved depilating coverage ensuring achieving the depilating effect desired per given skin area without requiring the user to pass the device over the same given skin area numerous times. In addition, it would be desirable to increase the hair plucking efficiency, without increasing the energy expenditure in using the device and without increasing the number of parts involved.

SUMMARY OF THE INVENTION

Accordingly, it is a principal object of the present invention to overcome the above-mentioned disadvantages and provide a hand-held, motorized depilating device for removing unwanted skin hair, introducing a novel mechanical design to provide improved depilating coverage, ensuring achieving the depilating effect desired per given skin area without requiring the user to pass the device over the same given skin area numerous times, and thereby increasing the hair plucking efficiency.

The present invention is based on U.S. Pat. No. 5,281,233 to Dolev and is essentially an improvement of the aforementioned patent. Instead of the hair-traps being lined up one after the other, i.e. in a tandem arrangement, the novel mechanical design enables the hair-traps to be lined up in a staggered manner and consequently cover the entire given skin area.

In accordance with a preferred embodiment of the present invention, there is provided a motor-powered depilating device comprising:

a hair-plucking assembly, coupled to motor means, and being exposed through an opening in a manually-held housing, said hair-plucking assembly being rotatable about an axis of rotation and including a plurality of disc assemblies, each disc assembly comprising:

a pair of complementary discs, each of said discs having at least two radial arms extending outwardly, each one of said complementary discs being mounted, respectively, on each of two axial faces of a hub having a predetermined thickness, said hub having at least two shoulders, each shoulder engaging one of said radial arms so as to impart rotational motion to said pair of discs upon rotation of said hub about the axis of rotation, said hub further including engagement means, for engaging at least one adjoining hub such that rotational motion of one hub imparts rotational motion to said adjoining hub, each of said a terminating in a flattened peripheral portion which, when pressed against a corresponding portion of a complementary disc in a pivoting motion about an edge of said hub, forms a trap for the hair, each trap lying in a predetermined one of a plurality of virtual planes, said dual planes comprising three substantially parallel planes orthogonal to the axis of rotation, including a centerplane bisecting said hub thickness, a first offset plane, spaced apart from said centerplane by a first offset dimension, and a second offset plane, spaced apart from said centerplane by a second offset dimension, said three virtual planes defining a plurality of contiguous depilating coverage zones on the skin surface within said offset dimensions, said at least two shoulders of said hub each having a pair of protrusions which extend axially from each of said shoulders towards adjoining disc assemblies, one on either side thereof, such that, at intervals, during the rotation of said plurality of said disc assemblies, said axial protrusions extend through open spaces between adjacent radial arms of said discs to press a radial arm of an adjoining disc assembly, so as to alternately close and open said hair-traps in said plurality of disc assemblies, thereby plucking skin hair with improved coverage within said depilating coverage zones, and releasing it.

In the preferred embodiment, the hair-plucking assembly is rotatable about a shaft and includes at least two disc assemblies. Each disc assembly comprises a pair of complementary discs, each of which has two or more radially extending arms which terminate in a flattened peripheral portion, which when pressed against a corresponding portion forms a trap for the hair. Each trap lies in a predetermined plane, constituting one of a plurality of virtual planes.

At least one of the radially extending arms and its opposing complementary disc arm are bent, so that the hair trap formed lies in a different predetermined virtual plane offset from the other hair-traps associated with the disc assembly, thus forming a staggered arrangement of hair-traps.

The disc assemblies also include a hub which accommodates a pair of complementary discs, one on each of its axial faces. Each hub has a predetermined thickness, upon which is mounted one of the complementary discs, on each of the two axial faces of the hub. The hub has three shoulders for engaging the arms of each of the discs, sol as to impart rotational motion to the discs upon the rotation of the hub. The hub has an edge, substantially perpendicular to the axis of rotation, about which each pair of arms of the pair of discs is pivotable, so as to alternately bring, two flattened peripheral portions into contact, thus closing a hair-trap, lying in one of the predetermined planes, and then opening the trap to release the depilated hairs.

The virtual planes are three substantially parallel planes orthogonal to the axis of rotation, a centerplane bisecting the hub thickness, a first offset plane, spaced apart from the centerplane by a first offset dimension, and a second offset plane, spaced apart from the centerplane by a second offset dimension. The virtual planes define depilating coverage zones within the offset dimensions.

At least one of the hair-traps, associated with each disc assembly, and formed by the flattened peripheral portion pressed against its corresponding portion, lies in a different predetermined plane than the other hair-traps associated with the disc assembly. This staggered arrangement results in improved depilating coverage within the depilating coverage zones defined by the offset dimensions.

Each shoulder of the hub has a pair of protrusions, each member of which extends axially from the shoulder towards an adjoining disc assembly. At intervals, during the rotation of the disc assemblies, the axial protrusions extend through the open spaces between adjacent radial arms of the discs to touch the nearer disc of an adjoining disc assembly, so as to alternately close and open the hair-traps lying in each of the virtual planes, thereby plucking skin hair within the contiguous depilating coverage zones, and releasing it.

In each of the disc assemblies, the hub has extending from one of its shoulders at least one pair of axial protrusions, extending axially in opposite directions, offset from the other pairs of axial protrusions of the hub. This enables closing and opening of the staggered arrangement of hair-traps and thereby improves the depilating coverage afforded by the plurality of disc assemblies.

The hub includes engagement means, for engaging at least one adjoining hub, such that rotational motion of one hub imparts rotational motion to at least one adjoining hub.

According to another embodiment, the hub's edge has formed thereon a pinch plate, which projects radially outwardly from the edge. The pinch plate is disposed in between and equidistant from the arms of complementary discs, so as to be substantially flush with the flattened peripheral portions of these arms.

Each pair of anus of the pair of discs is pivotable about the edge so as to alternately bring two flattened peripheral portion and the pinch plate into contact thus closing two hair-traps simultaneously and then opening the traps to release the depilated hairs. This doubles the number of hair-traps closed simultaneously and thereby, greatly increases depilating efficiency.

According to the preferred embodiment, in accordance with the principles of the present invention, the hubs are rotatably mounted on a fixed arcuate shaft and each hub includes engagement means for engaging at least one adjacent hub so that rotational motion of one hub imparts rotational motion to an adjacent hub. Trap opening and closing is accomplished by using a motion control means employing inclined pressure bearings.

According to another embodiment, the hubs are rotatably mounted on a straight shaft, and trap opening and closing is accomplished by using a motion control means employing cams or inclined thrust bearings.

Other features and advantages of the invention will become apparent from the drawings and the description contained herein below.

BRIEF DESCRIPTION OF DRAWINGS

For a better understanding of the invention, reference is made to the accompanying drawings, in which like numbers designate corresponding elements or sections throughout, and in which:

FIG. 4 shows another perspective view of the disc assembly of FIG. 2;

FIG. 5 displays a cross sectional view of the disc assembly of FIG. 4;

FIG. 6 is a perspective view of the disc assembly of FIG. 4, featuring a pinch plate feature, which doubles the number of hair-traps;

FIG. 7 displays a cross sectional view of the disc assembly of FIG. 6;

FIG. 8 schematically illustrates the layout of the hair-traps located on the circumference of the hair plucking assembly of a prior art depilating device;

DETAILED DESCRIPTION OF A PREFERRED EMBODIMENT

Figure 1:
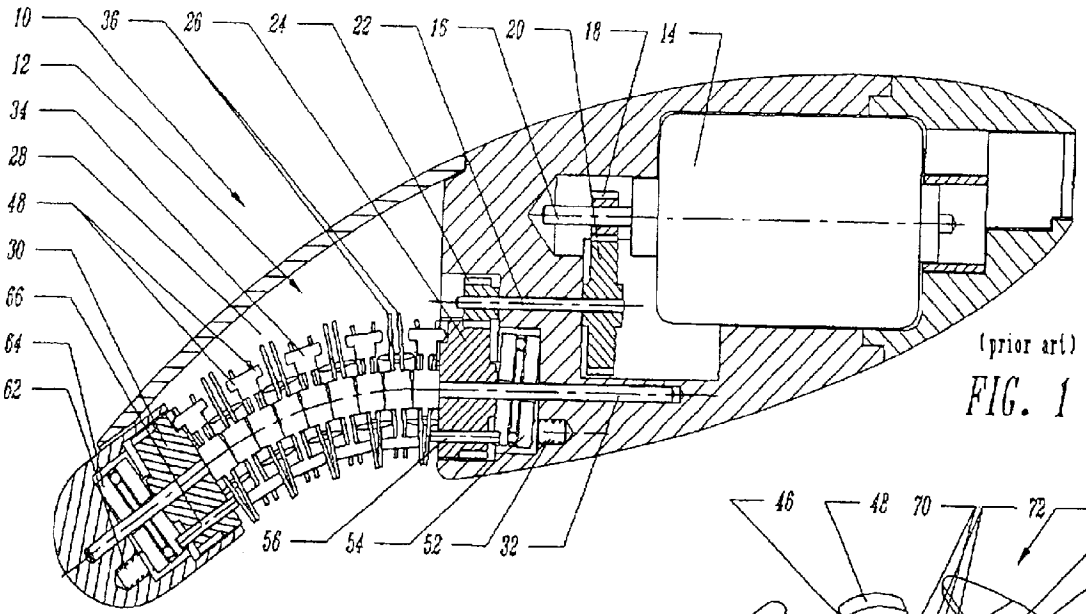
(prior art) FIG. 1
FIG. 1 is a cross-sectional view of a prior art depilating device as shown and described in U.S. Pat. No. 5,281,233 to Dolev, featuring a number of disc assemblies.
Figure 3:
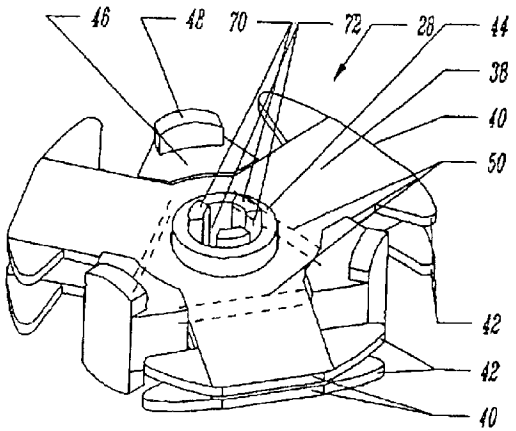
FIG. 3 (prior art)
FIG. 3 is a perspective view of the disc assembly of FIG. 2.
Figure 2:
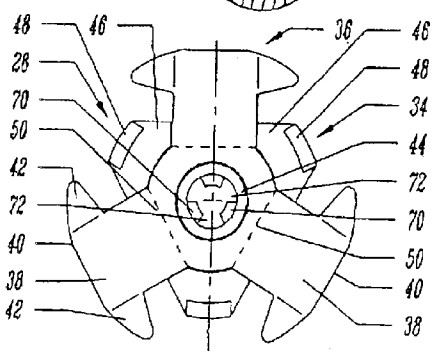
FIG. 2 (prior art)
FIG. 2 is a plan view of a disc assembly used in the device of FIG. 1.

FIGS. 1–3 are reproduced from U.S. Pat. No. 5,281,233 to Dolev, inventor of the present invention. The figures are thoroughly described therein with regard to the reference numbers shown. Therefore, the following description relates only to the specific features of interest for which a description is required in order to compare the previous and present inventions.

FIG. 1 is a cross-sectional view of a; prior art depilating device as shown: and described in U.S. Pat. No. 5,281,233 to Dolev, featuring a number of disc assemblies. The hair plucking assembly 12 is shown, comprising one or more disc assemblies 28. Each of disc assemblies 28 is rotatably mounted on an arcuate shaft 32. The curved portion of arcuate shaft 32 has a constant radius of curvature, such that disc assemblies 28 are caused with the assistance of inclined thrust bearings 54 and 64 and push rods 56 and 66 to efficiently and smoothly close and open hair-traps.

FIG. 2 is a plan view of a disc assembly used in the device of FIG. 1. Disc assembly 28 is comprised of three major parts a hub 34, and a pair of discs 36.

FIG. 3 is a perspective view of the disc assembly of FIG. 2. Each of discs 36 has at least one radially extending arm 38, emanating from its center. Each arm 38 terminates in a flattened peripheral portion 40. When flattened peripheral portion 40 is pressed against the corresponding flattened peripheral portion 40 of the complementary disc 36 a trap is formed. The central portion of each disc 36 has an opening, which is sized and shaped to fit over a projection of hub 34. Hub 34 has shoulders 46, one shoulder 46 per arm 38 of disc 36. Shoulders 46 are sized and shaped so that the trailing edge of each arm 38 abuts against a portion of one of shoulders 46. A rotational motion of hub 34 transmits the same rotational motion to discs 36. Hub 34 includes a series of axial engagement protrusions 70 and recessions 72, for engaging corresponding portions in the adjacent hub, to impart rotational motion between disc assemblies. Extending from shoulders 46 of hub 34 is a pair of axial protrusions 48, extending axially in opposite directions. When a particular set of axial protrusions 48 is located in the concave configuration produced by the curvature of arcuate shaft 32, axial protrusions 48 extend through the open spaces between adjacent arms 38 of discs 36 to touch the nearer disc 36 of an adjoining disc assembly 28, thereby causing the adjoining disc assembly 28, to form a trap. (See FIG. 1). Hub 34 includes an edge 50, which lies between each pair of corresponding arms 38 of complementary discs 36.

Whenever axial protrusions 48 of adjoining disc assemblies 28 press discs 36 together, a pair of arms 38 of complementary discs 36 pivot slightly towards each other about the corresponding edge 50 of hub 34 located between the pair of arms 38. This pivoting brings the pair of flattened peripheral portions 40 at the end of the pair of arms 38 together in parallel fashion to form a trap.

FIG. 4 shows another perspective view of the disc assembly of FIG. 2. As shown by the directional arrows A in the diagram the radially extending arms 38 pivot about an axis oriented parallel to the peripheral portions 40 of the hair-trap.

FIG. 5 displays a cross sectional view of the disc assembly of FIG. 4.

FIG. 6 is a perspective view of a disc assembly, incorporating a pinch plate, as described in the above-referenced Doles patent (U.S. Pat. No. 5,281,233), at col. 7, lines 27–42. The edge 50 of hub 34 includes a pinch plate 39, which projects radially outward from edge 50, and which doubles the number of hair-traps.

FIG. 7 displays a sectional view of the apparatus of FIG. 6. The pivoting of arms 38 of discs 36 towards each other effects the creation of two traps. One trap is formed between one face of the pinch plate 39 and one of flattened peripheral portions 40 and the other trap is formed between the other face of the pinch plate 39 and the flattened peripheral portion 40 of the complementary disc 36.

FIG. 8 schematically illustrates the layout of the hair-traps located on the circumference of the hair plucking assembly 12 of a prior art depilating device. It can be clearly seen that the width of the depilating coverage zones of the traps is very narrow and strips of skin, between these zones, are not treated. Since these zones are not contiguous, the device's efficiency is reduced and consequently, the user must pass the device over the same given skin area several times in order to achieve the depilating effect desired.

Figure 9:
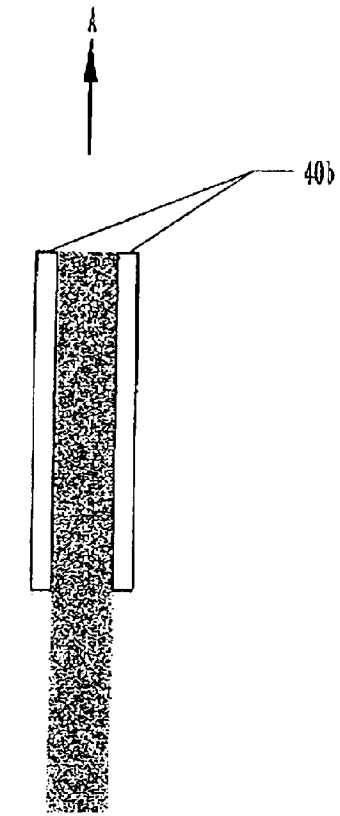
FIG. 9 (prior art)
FIG. 9 schematically illustrates the width of the depilating coverage zone of a standard hair-trap, transported by the hair plucking assembly in the direction of arrow A.

FIG. 9 schematically illustrates the width of the depilating coverage zone of a standard hair-trap, transported by the hair plucking assembly in the direction of arrow A in the diagram. For illustrative purposes, the entrance width between the opposing edges 40*b* of the trap is given as 1.0 mm.

Figure 10:
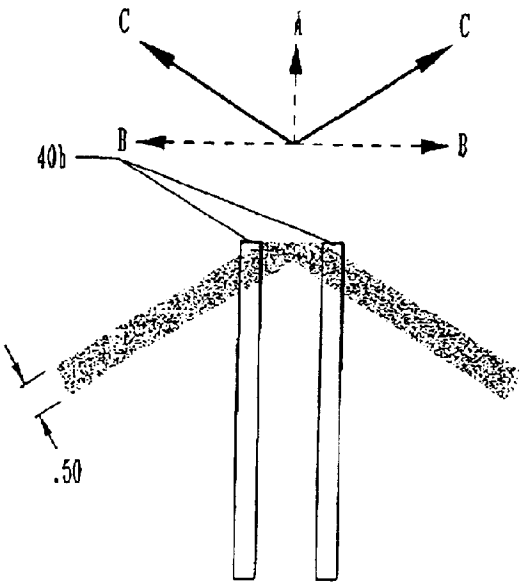
FIG. 10 (prior art)
FIG. 10 schematically illustrates the width of the depilating coverage zone; of a hair-trap, being transported by the hair plucking assembly from side to side; while the hair plucking device moves in the direction of arrow A (as suggested by Inoue)

FIG. 10 schematically illustrates the width of the depilating coverage zone of a hair-trap, being transported by the hair plucking assembly from side to side, as shown by the directional arrows B in the diagram, while the hair plucking assembly simultaneously moves forward, as shown by the directional arrows A in the diagram (as suggested by Inoue). The resultant vector of these two motions is the actual displacement and its direction is diagonal, as shown by the directional arrows C in the diagram. This motion greatly reduces, as can clearly be seen, the effective width of the depilating coverage zone of the hair-trap. The effective entrance width between the opposing edges 40*b* of the trap is now only 0.5 mm.

Figure 11:
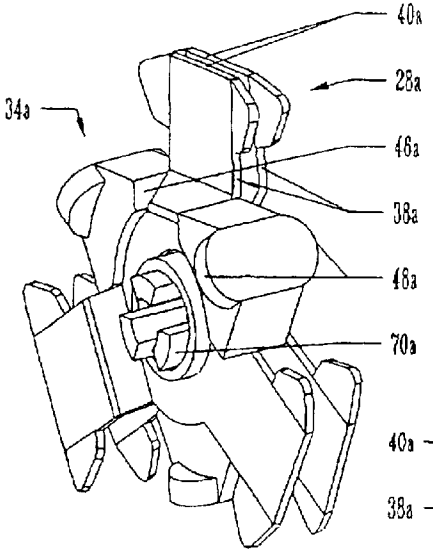
FIG. 11 is an isometric view of a disc assembly, constructed and operated, in accordance with the principles of the present invention, not incorporating the pinch plate feature, showing two of the radially extending arms offset from the centerplane of the disc assembly, one to each side.

FIG. 11 is an isometric view of a disc assembly, constructed and operated, in accordance with the principles of the present invention, not incorporating the pinch plate feature, showing two sets of radially extending arms 38*a* offset from the centerplane of the disc assembly. Extending from shoulders 46*a* of hub 34*a* is a pair of axial protrusions 48*a*, extending axially in opposite directions. When a particular set of axial protrusions 48*a* is located in the concave configuration produced by the curvature of arcuate shift 32, axial protrusions 48*a* extend through the open spaces between adjacent arms 38*a* of discs 36*a* to touch the nearer disc 36*a* of an adjoining disc assembly 28*a*, thereby causing the adjoining disc assembly 28*a* to form a trap.

Figure 12:
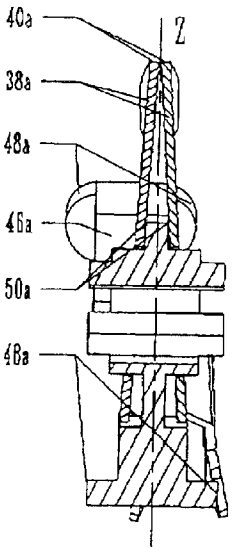
FIG. 12 is a cross sectional view of the disc assembly of FIG. 11, along the the radially extending arm that is centered on the centerplane of the disc assembly.

FIG. 12 is a cross sectional view of the disc assembly of FIG. 11, along the radially extending arm that is centered on the centerplane of the disc assembly. Whenever axial protrusions 48*a* of adjoining disc assemblies 28*a* press discs 36*a* together, a pair of arms 38*a* of complementary discs 36*a* pivot slightly towards each other about the corresponding edge 50*i* of hub 34*a* located between the pair of arms 38*a*. This pivoting brings the pair of flattened peripheral portions 40*a* at the end of the pair of arms 38*a* together in parallel fashion to form a trap.

Figure 13:
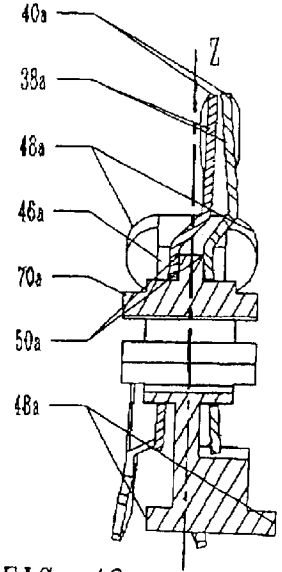
FIG. 13 is a cross sectional view of the disc assembly of FIG. 11, along the radially extending arm that is offset to the right of the centerplane of the disc assembly.

FIG. 13 is a cross sectional view of the disc assembly of FIG. 11, along the radially extending arm that is offset to the right of the centerplane of the disc assembly.

Figure 14:
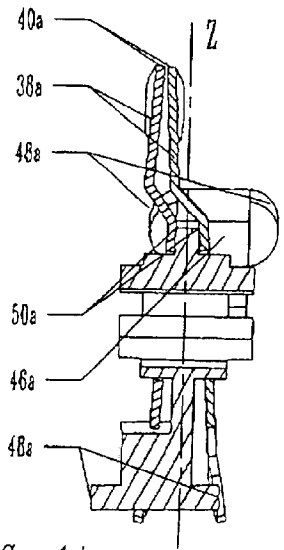
FIG. 14 is a cross sectional view of the disc assembly of FIG. 11, along the radially extending arm that is offset to the left of the centerplane of the disc assembly.

FIG. 14 is a cross sectional view of the disc assembly of FIG. 11, along the radially extending arm that is offset to the left of the centerplane of the disc assembly.

Figure 15:
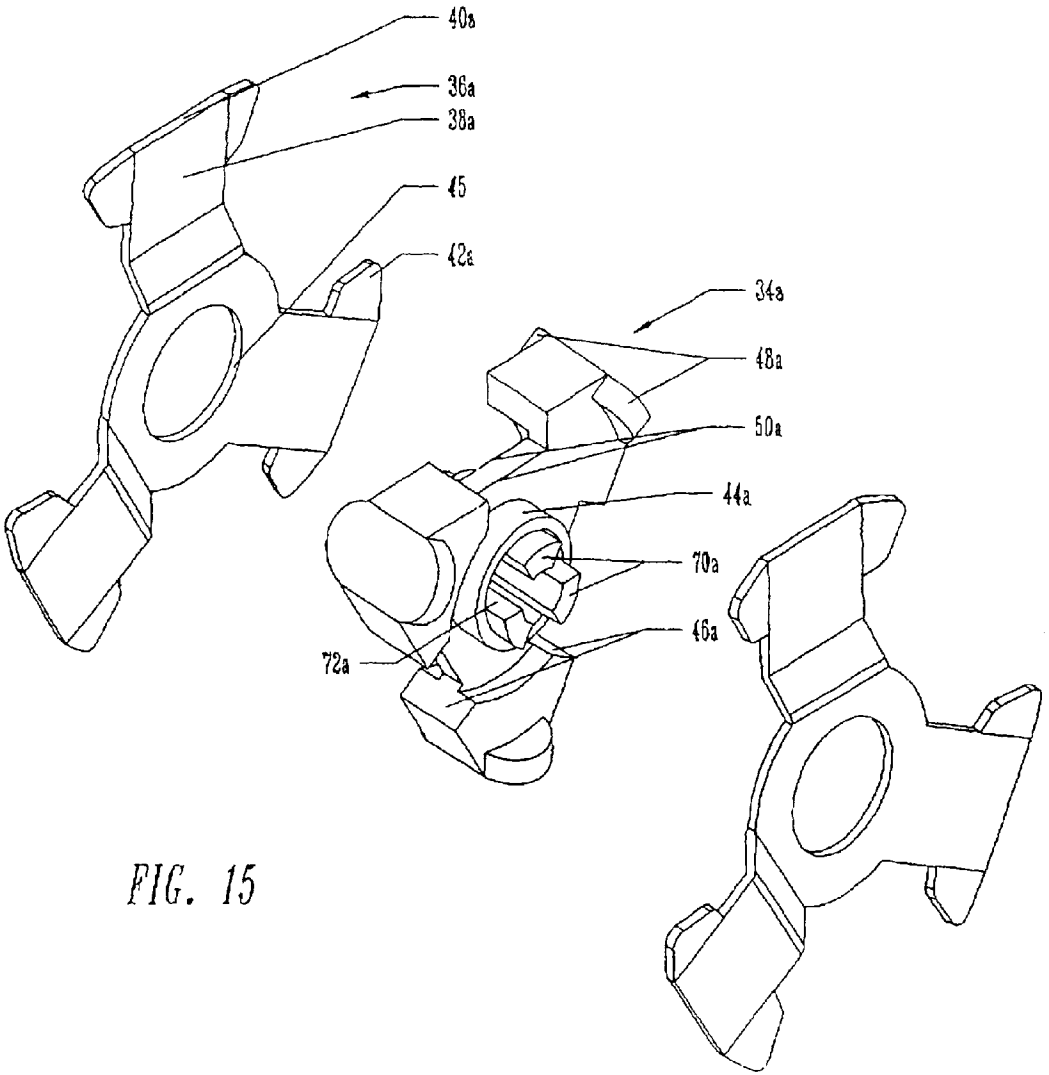
FIG. 15 is an exploded isometric view of the depilating device disc assembly of the present invention, shown is FIG. 11.

FIG. 15 is an exploded isometric view of the depilating device disc assembly of the present invention, shown in FIG. 11. Each of discs 36*a* has at least two radially extending arms 38*a*, emanating from its center. Each arm 38*a* terminates in a flattened peripheral portion 40*a*. When flattened peripheral portion 40*a* is pressed against the corresponding flattened peripheral portion 40*a* of the complementary disc 36*a* a trap is formed. The central portion of each disc 36*a* has an opening 45, which is sized and shaped to fit over a projection of hub 34*a*. Hub 34*a* has shoulders 46*a*, one shoulder 46*a* per arm 38*a* of disc 36*a* Shoulders 46*a* are sized and shaped so that the trailing edge of each arm 38*a* abuts against a portion of one of shoulders 46*a* A rotational motion of hub 34*a* transmits the same rotational motion to discs 36*a*. Hub 34*a* includes a series of axial engagement protrusions 70*a*, for engaging depressions 72*a* in the adjacent hub, to impart rotational motion to adjacent disc assemblies. The offsets of the radial arms 38*a*, axial projections 48*a* and shoulders 46 extending right and left of the centerplane of the disc assembly can be clearly seen.

Figure 16:
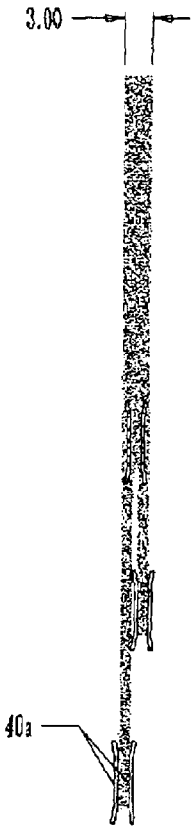
FIG. 16 schematically illustrates the: layout of the hair-traps of the disc assembly, as shown in FIGS. 11–15.

FIG. 16 schematically illustrates the layout of the hair-traps of one disc assembly, as shown in FIGS. 11–15. It is clear that the staggered layout of the hair-traps affords a much wider zone of depilating coverage than that afforded by the tandem layout shown in FIG. 8.

Figure 17:
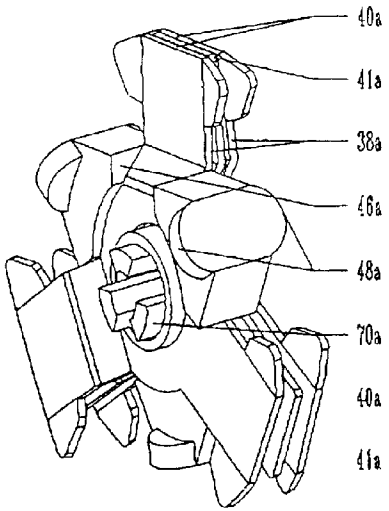
FIG. 17 is an isometric view of a disc assembly, constructed and operated, in accordance with the principles of the present invention, featuring a pinch plate, and showing two of the radially extending arms and their associated pinch plate offset from the centerplane of the disc assembly, one to each side.

FIG. 17 is an isometric view of a disc assembly, constructed and operated, in accordance with the principles of the present invention, featuring pinch plates, and showing two of the radially extending terms and their associated pinch plate offset from the centerplane of the disc assembly.

Figure 18:
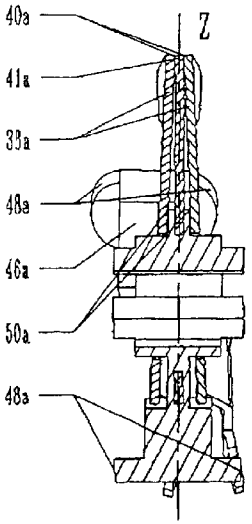
FIG. 18 is a cross sectional view of the disc assembly of FIG. 17, along the radially extending arm that is centered on the centerplane of the disc assembly.

FIG. 18 is a cross sectional view of the disc assembly of FIG. 17, along the radially extending arm that is centered on the centerplane of the disc assembly.

Figure 19:
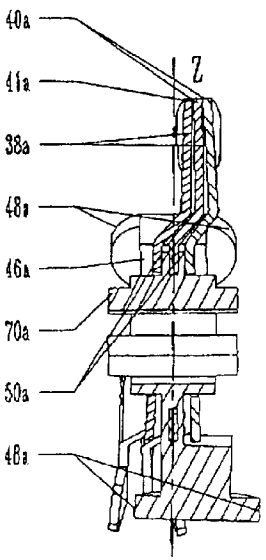
FIG. 19 is a cross sectional view of the disc assembly of FIG. 17, along the radially extending arm that is offset to the right of the centerplane of the disc assembly.

FIG. 19 is a cross sectional view of the disc assembly of FIG. 11, along the radially extending arm that is offset to the right of the centerplane of the disc assembly.

Figure 20:
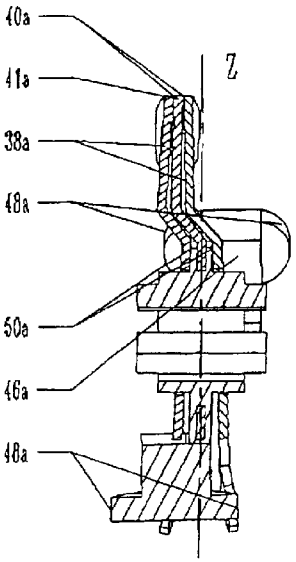
FIG. 20 is a cross sectional view of the disc assembly of FIG. 17, along the, radially extending arm that is offset to the left of the centerplane of the disc assembly.

FIG. 20 is a cross sectional view of the disc assembly of FIG. 17, along the radially extending arm that is offset to the loft of the centerplane of the disc assembly.

Figure 21:
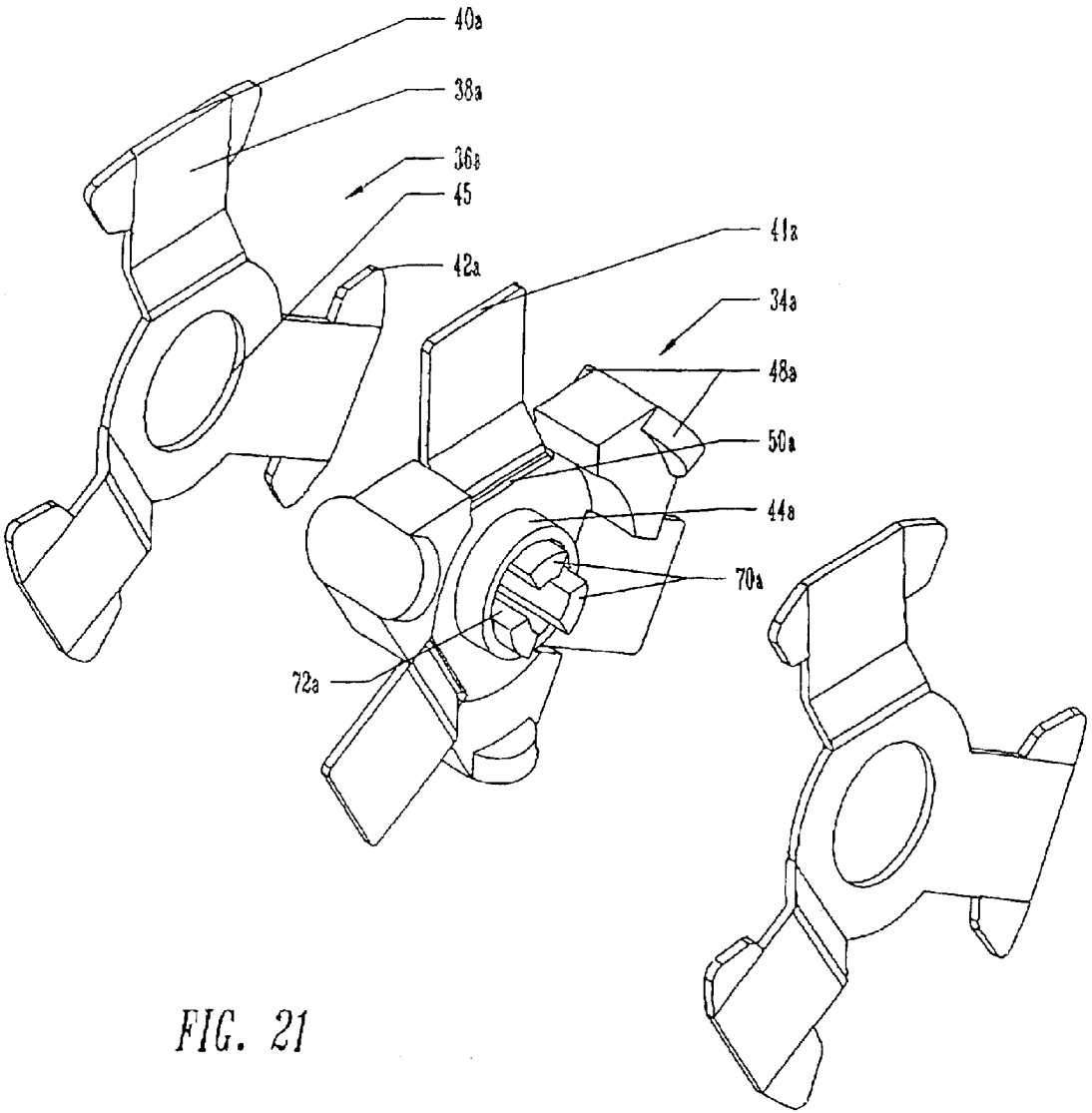
FIG. 21 is an exploded isometric view of the depilating device disc assembly of the present invention, highlighting the pinch plates, shown in FIG. 7.

FIG. 21 is an exploded isometric view of the depilating device disc assembly of the present invention, shown in FIG. 17. The edge 50*a* of the hub 34*a* includes a pinch plate 41*a*, which projects radially outwardly from the edge 50*a*. The pinch plate 41*a* is disposed in between and equidistant from the arms 38*a* of complementary discs, so as to be substantially flush with the flattened peripheral portions 40*a* of these arms. In each of the disc-like assemblies, there are offset pinch plates 41*a* corresponding to offset flattened peripheral portions 40*a*. The offset mounting of the flattened peripheral portions is either on one side or the other of the centerplane of the disc assembly.

Figure 22:
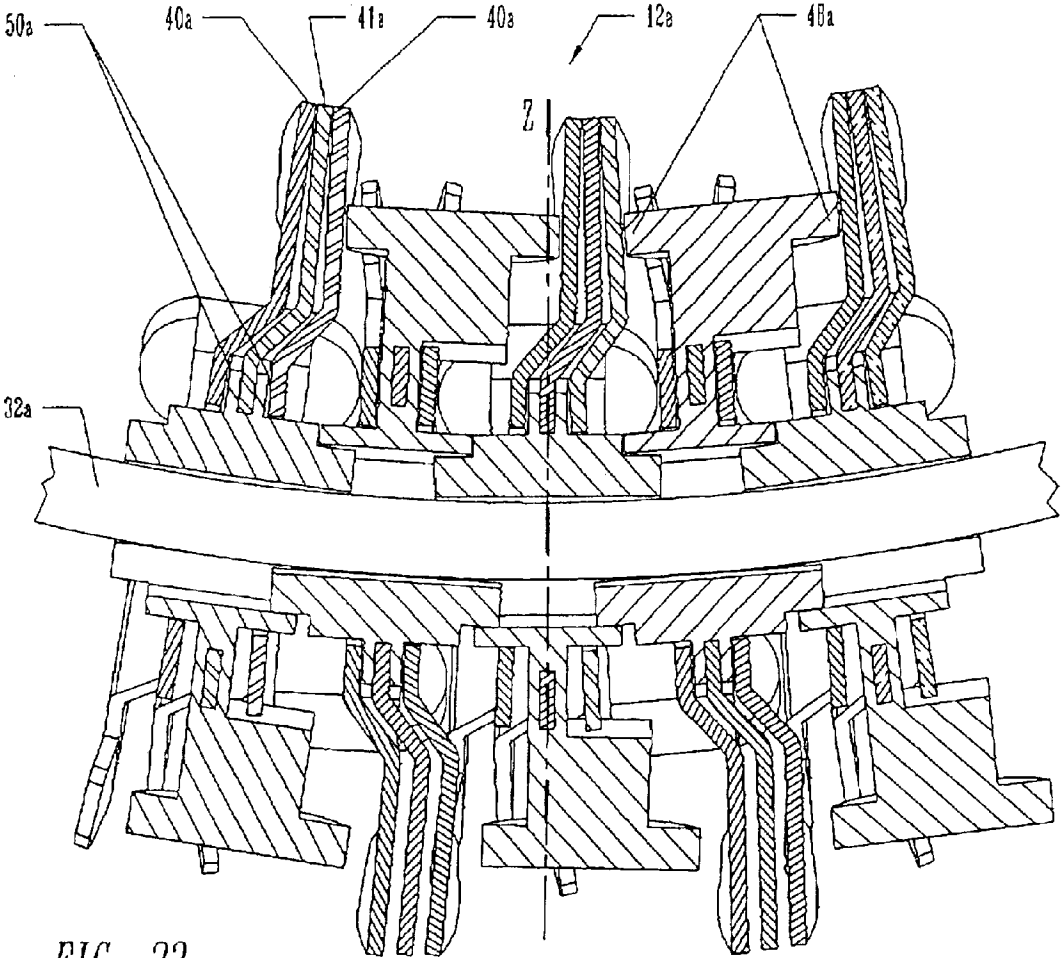
FIG. 22 is a cross-sectional view of the hair plucking assembly of the present invention, incorporating pinch plates, featuring a number of disc assemblies, showing radially extending arms that are offset to the right of the centerplane of the disc assemblies.

FIG. 22 is a cross-sectional view of the hair plucking assembly of the present invention, incorporating pinch plates, and featuring a number of disc assemblies, showing radially extending arms that are offset to the right of the centerplane Z of the disc assemblies. Axial protrusions 48*a* extend through the open spaces between adjacent arms 38*a* of discs 36*a* to touch the nearer disc 36*a* of an adjoining disc assembly 28*a*, thereby causing the adjoining disc assembly 28*a* to form a trap.

Figure 23:
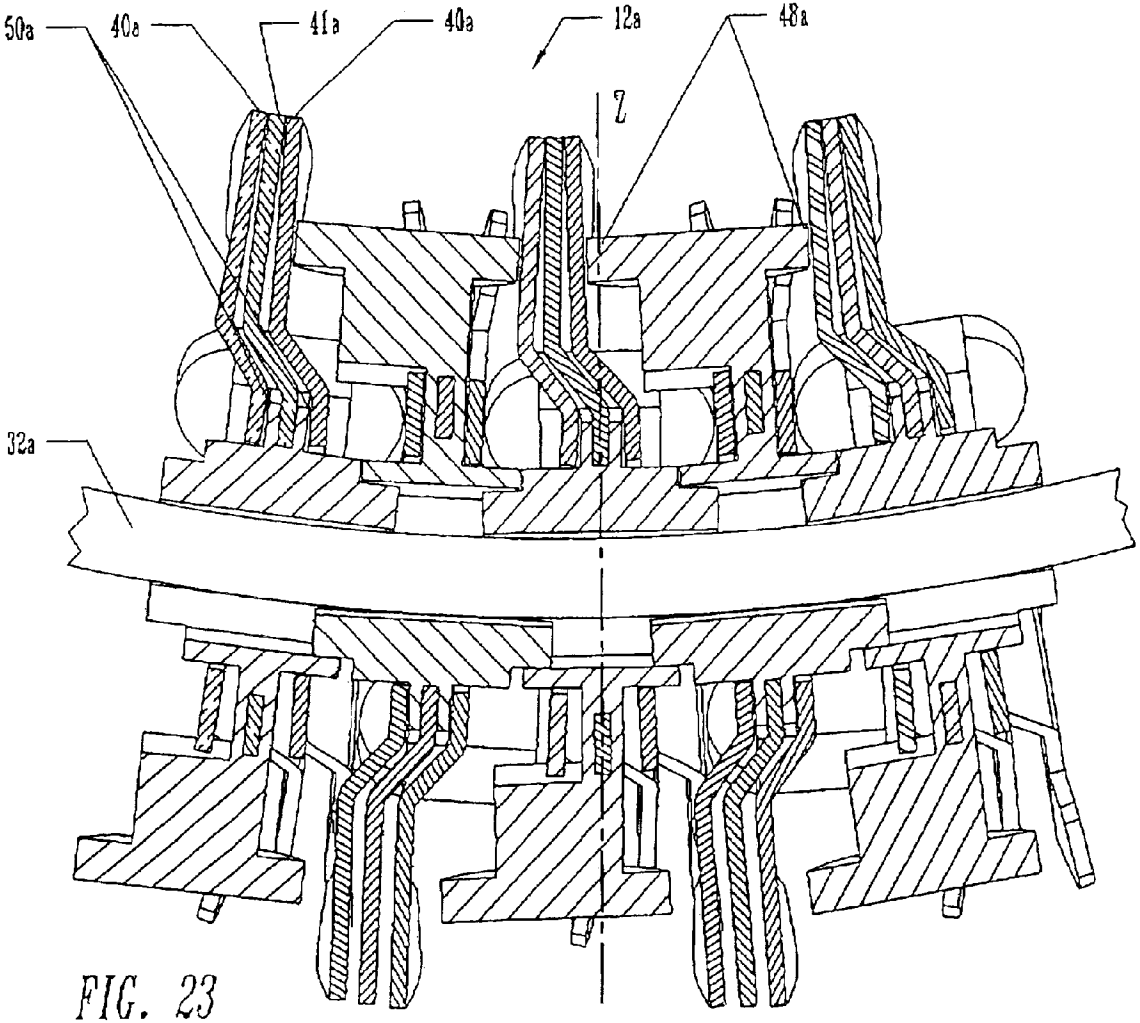
FIG. 23 is a cross-sectional view of the hair plucking assembly of the present invention, incorporating pinch plates, featuring a number of disc assemblies, showing radially extending arms that are offset to the left of the centerplane of the disc assemblies.

FIG. 23 is a cross-sectional view of the hair plucking assembly of the present invention, incorporating pinch plates, featuring a number of disc assemblies, showing radially extending arms that are offset to the left of the centerplane Z of the disc assemblies.

Figure 24:
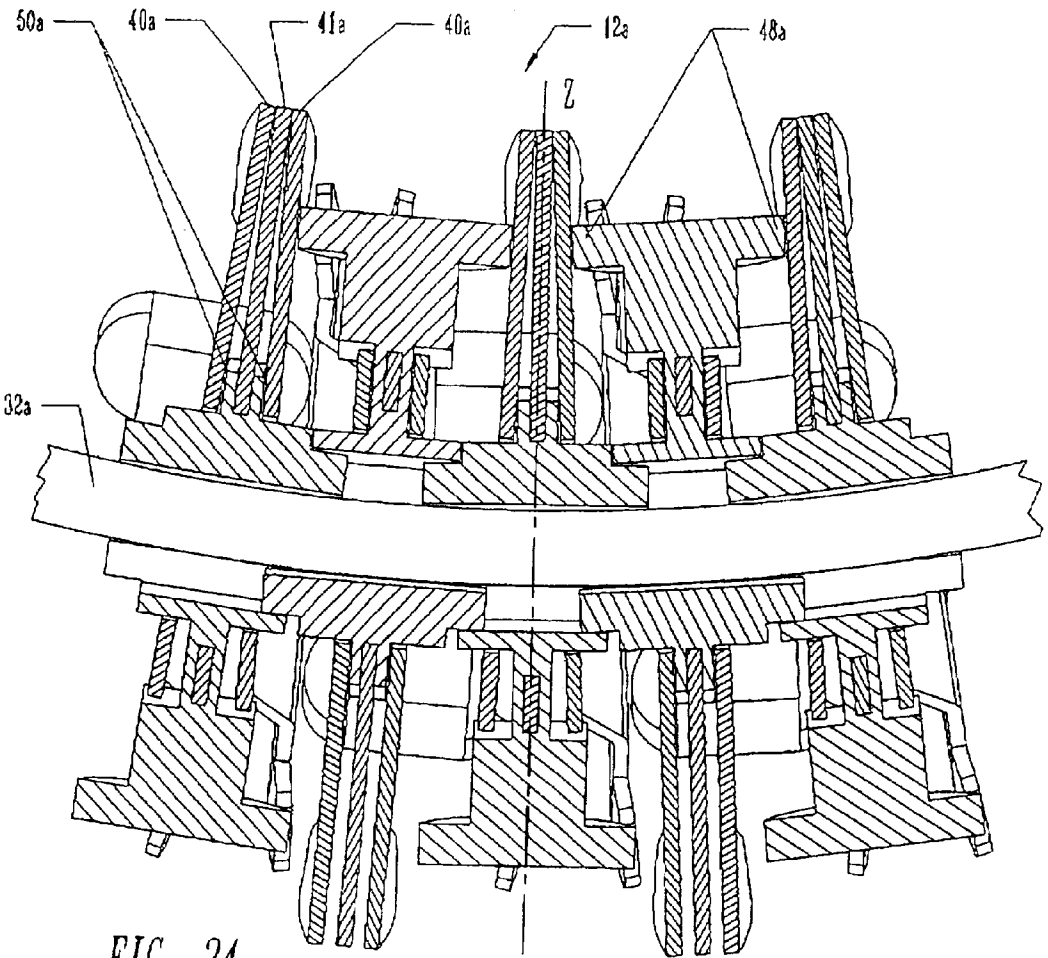
FIG. 24 is a cross-sectional view of the hair plucking assembly of the present invention, incorporating pinch plates, featuring a number of disc assemblies, showing radially extending arms that are centered on the centerplane of the disc assemblies.

FIG. 24 is a cross-sectional view of the hair plucking assembly of the present invention, incorporating pinch plates, featuring a number of disc assemblies, showing radially extending arms that are centered on the centerplane Z of the disc assemblies. Each disc assembly is able to form traps by utilizing its own flattened peripheral portion 40*a* components. Trap closing activation force is transmitted between adjacent discs by axial protrusions 48*a*.

Figure 25:
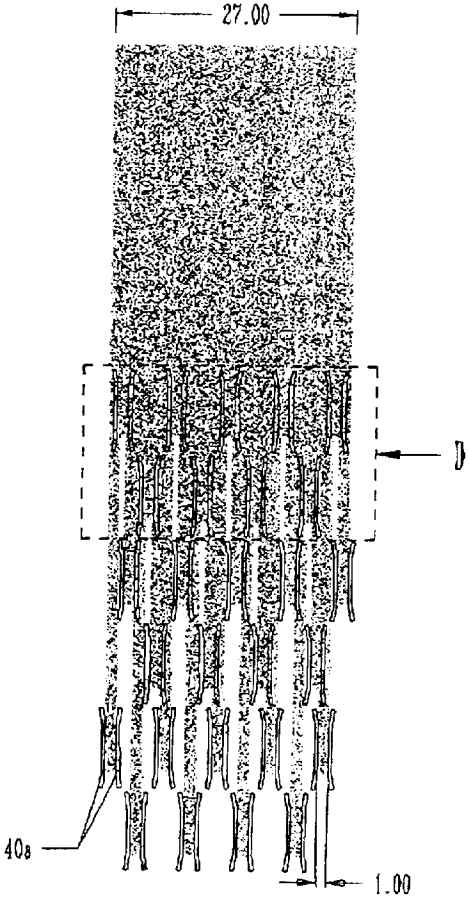
FIG. 25 schematically illustrates die staggered layout of the ha-traps, without pinch plates, located on the circumference of the hair plucking assembly, of the present invention.

FIG. 25 schematically illustrates the staggered layout of the hair-traps, without pinch plates, located on the circumference of the hair plucking assembly of the present invention. For illustrative purposes, the entrance width between the opposing edges 40*a* of the trap is given as 1.0 mm. It may be clearly seen that the zones of depilating coverage of all the traps touch each other, not leaving any gaps of untreated skin, resulting in a plurality of contiguous depilating coverage zones, enabling the user to achieve maximum depilating coverage in a single pass of the device over a given skin area. In this embodiment, full depilating coverage is achieved by using nine disc assemblies (see area "D").

Figure 26:
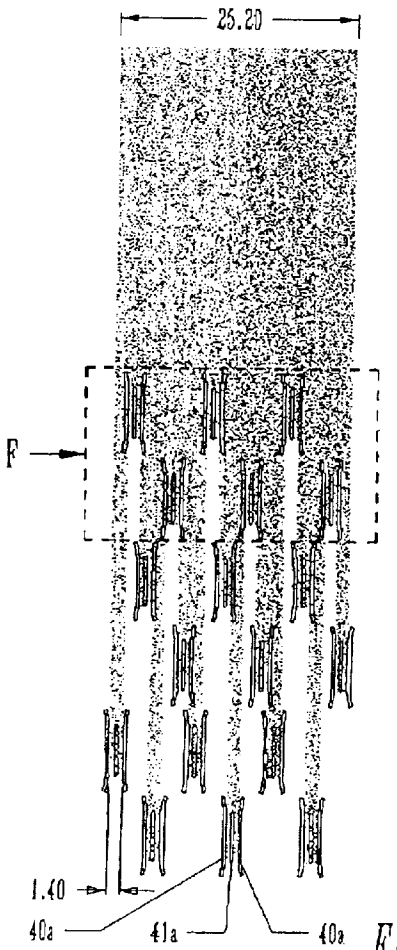
FIG. 26 schematically illustrates the staggered layout of the hair-traps, featuring pinch plates, located on the circumference of the hair plucking assembly of the present invention.

FIG. 26 schematically illustrates the staggered layout of the hair-traps, featuring pinch plates, located on the circumference of the hair plucking assembly of the present invention. The entrance width between the opposing edges 40*a* of the trap, in this figure, is now given as 1.4 mm, indicating that the thickness of the pinch plate is 0.4 mm. It may be clearly seen that the zones of depilating coverage of all the traps touch each other, not leaving any gaps of untreated skin, resulting in a plurality of contiguous depilating coverage zones, enabling the user to achieve maximum depilating coverage in a single pass of the device over a given skin area. Adding pinch plates doubles the number of hair-traps closed simultaneously and thereby, greatly increases depilating efficiency. In addition, in this embodiment, fill depilating coverage is achieved by only using six disc assemblies (see area "F"), as opposed to die nine disc assemblies required in the present invention embodiment that does not utilize pinch plates, as shown in FIG. 25, resulting in reductions in both material and complexity.

Having described the invention with regard to certain specific embodiments, it is to be understood that the description is not meant as a limitation since further modifications may now suggest themselves to those skilled in the art, and it is intended to cover such modifications, as fall within the scope of the appended claims.

I claim:

1. A motor-powered depilating device comprising:

a hair-plucking assembly, coupled to motor means, and being exposed through an opening in a manually-held housing, said hair-plucking assembly being rotatable about an axis or rotation and including a plurality of disc assemblies, each disc assembly comprising:

a pair of complementary discs, each of said discs having at least two radial arms extending outwardly, each one of said complementary discs being mounted, respectively, on each of two axial faces of a hub having a predetermined thickness, said hub having at least two shoulders, each shoulder engaging one of said radial arms so as to impart rotational motion to said pair of discs upon rotation of said hub about the axis of rotation, said hub further including engagement means, for engaging at least one adjoining hub such that rotational motion of one hub imparts rotational motion to said adjoining hub, each of said radial arms terminating in a flattened peripheral portion which, when pressed against a corresponding portion of a complementary disc in a pivoting motion about an edge of said hub, forms a trap for the hair, each trap lying in a predetermined one of a plurality of virtual planes, said virtual planes comprising three substantially parallel planes orthogonal to the axis of rotation, including:

a centerplane bisecting said hub thickness, a first offset plane, offset from said centerplane by a first offset dimension, and a second offset plane, offset from said centerplane by a second dimension, said three virtual planes defining a plurality of contiguous depilating coverage zones on the skin surface within said offset dimensions, said at least two shoulders of said hub each having a pair of protrusions which extend axially from each of said shoulders towards adjoining disc assemblies, one on either side thereof, such that, at intervals, during the rotation of said plurality of said disc assemblies, said axial protrusions extend through open spaces between adjacent radial arms of said discs to press a radial arm of an adjoining disc assembly, so as to alternately close and open said hair-traps in said plurality of disc assemblies, wherein at least one of said radially extending arms and its opposing complementary disc radial arm are bent, so that the hair-trap formed thereby lies in a different one of said predetermined virtual planes offset from another hair-trap associated with said disc assembly, thus forming a staggered arrangement of hair-traps, said staggered arrangement of hair-traps thereby plucking skin hair with improved coverage within said depilating coverage zones, and releasing said plucked skin hair.

2. The device of claim 1, wherein said staggered arrangement of hair-traps is provided by three radial arms extending outwardly, forming three hair-traps per disc assembly, in which each hair-trap lies in a different predetermined virtual plane than each of the other two hair-traps.

3. The device of claim 1, wherein said staggered arrangement of hair-traps is provided by three radial arms extending outwardly, forming three traps per disc assembly, and wherein at least one of said hair-traps, associated with each disc assembly, lies in a different predetermined virtual plane than the other hair-traps associated with said disc assembly.

4. The device of claim 1, wherein at least one pair of said axial protrusions, associated with each disc assembly, is offset from the other pairs of said axial protrusions, thus enabling closing and opening of said staggered arrangement of hair-traps offset from one another on said adjoining disc assembly, and thereby improving the depilating coverage afforded by said plurality of disc assemblies.

5. The device of claim 1, wherein said hub further comprises pinch plates extending radially outwardly therefrom, at least one of said pinch plates being disposed in between and equidistant from said bent arms of said complementary discs, so as to be substantially flush with said flattened peripheral portions of said bent arms, thereby doubling the number of hair-traps, and greatly increasing depilating efficiency.

6. The device of claim 1, wherein said at least one hub is rotatably mounted on a fixed arcuate shaft, said arcuate shaft having a convex portion and a concave portion.

7. The device of claim 1, wherein said at least one hub is rotatably mounted on a rotatable substantially straight shaft.

8. The device of claim 1, wherein full depilating coverage is achieved by utilizing nine disc assemblies.

9. The device of claim 5, wherein, due to the addition of said pinch plates, depilating coverage is greatly improved, thus enabling full depilating coverage to be achieved by utilizing less than nine disc assemblies.

10. A method of hair depilation comprising:

providing a hair depilating device, having a hair plucking assembly, coupled to motor means, and being exposed through an opening in a manually-held housing said hair-plucking assembly being rotatable about an axis of rotation and including a plurality of disc assemblies, each disc assembly comprising:

a pair of complementary discs, each of said disc having at least two radial arms extending outwardly, each one of said complementary discs being mounted, respectively, on each of two axial faces of a hub having a predetermined thickness, said hub having at least two shoulders, each shoulder engaging one of said radial arms so as to impart rotational motion to said pair of discs upon rotation of said hub about the axis of rotation, said hub further including engagement means, for engaging at least one adjoining hub such that rotational motion of one hub imparts rotational motion to said adjoining hub, each of said radial arms terminating in a flattened peripheral portion which, when pressed against a corresponding portion of a complementary disc in a pivoting motion about an edge of said hub, forms a trap for the hair, each trap lying in a predetermined one of a plurality of virtual planes, said virtual planes comprising three substantially parallel planes orthogonal to the axis of rotation, including:

a centerplane bisecting said hub thickness, a first offset plane, offset from said centerplane by a first dimension, and a second offset plane, offset from said centerplane by a second dimension, said three virtual planes defining a plurality of contiguous depilating coverage zones on the skin surface within said offset dimensions, said at least two shoulders of said hub each having a pair of protrusions which extend axially from each of said shoulders towards adjoining disc assemblies, one on either side thereof, and rotating said plurality of disc assemblies such that, at intervals, during said rotation, said axial protrusions extend through open spaces between adjacent radial arms of said disco to press a radial arm of an adjoining disc assembly, so as to alternately close and open said hair-traps in said plurality of disc assemblies, wherein at least one of said radially extending arms and its opposing complementary disc radial arm are bent, so that the hair-trap formed thereby lies in a different one of said predetermined virtual planes offset from another hair-trap associated with said disc assembly, thus forming a staggered arrangement of hair-traps, said staggered arrangement of hair-traps thereby plucking skin hair with improved coverage within said depilating coverage zones, and releasing said plucked skin hair.

11. The method of claim 10 wherein during said rotation, said hair depilating device is passed over the skin from which hair is to depilated, with improved depilating coverage, without requiring said device to pass over the same skin area numerous times.

12. The method of claim 10 wherein said staggered arrangement of hair-traps greatly increases the depilating coverage.

13. The method of claim 10 wherein during said rotation, said hair depilating device is passed over the skin from which hair is to depilated, with maximum depilating coverage in a single pass of the device.

14. The method of claim 10 wherein said depilation is performed in a plurality of contiguous depilating coverage zones.

15. The method of claim 10, wherein said hub further comprises pinch plates extending radially outwardly therefrom, at least one of said pinch plates being disposed in between and equidistant from said bent arms of said complementary discs, so as to be substantially flush with said flattened peripheral portions of said bent arms, thereby doubling the number of hair-traps, and greatly increasing depilating efficiency when said device is passed over the skin surface.

16. The method of claim 10 wherein hair depilation is performed by nine disc assemblies.

17. The method of claim 15 wherein hair depilation is performed by less than nine disc assemblies.

* * * * *